United States Patent [19]

Balch

[11] Patent Number: 4,512,547

[45] Date of Patent: Apr. 23, 1985

[54] LOCKING DRAIN VALVE

[75] Inventor: Duane C. Balch, Napa, Calif.

[73] Assignee: Chartwell Corporation, Line Lexington, Pa.

[21] Appl. No.: 492,450

[22] Filed: May 6, 1983

[51] Int. Cl.[3] ..... F16K 35/02

[52] U.S. Cl. ..... 251/115; 251/144; 251/297; 251/301

[58] Field of Search ..... 251/DIG. 1, 144, 301, 251/300, 297, 115, 327, 326; 184/1.5; 165/71

[56] References Cited

U.S. PATENT DOCUMENTS

| | | | |
|---|---|---|---|
| 303,656 | 8/1884 | Metzger et al. | 285/158 |
| 450,588 | 4/1891 | Lunkenheimer | 251/302 |
| 562,410 | 6/1896 | Moon | 251/115 X |
| 606,025 | 6/1898 | Perry | 251/300 |
| 1,870,557 | 8/1932 | Curd | 251/297 X |
| 2,071,717 | 2/1937 | Winkle | 251/297 X |
| 2,095,696 | 10/1937 | Hackel | 137/54 |
| 2,487,194 | 11/1949 | Snow | 251/301 |
| 2,636,518 | 4/1953 | Strebel | 251/300 X |
| 2,657,705 | 11/1953 | Gerhard et al. | 137/351 |
| 3,035,602 | 5/1962 | Johnson | 137/315 |
| 3,049,334 | 8/1962 | Montague | 251/216 |
| 3,207,470 | 9/1965 | Kuckhoff | 251/300 X |
| 3,677,369 | 7/1972 | Schramm | 184/1.5 |
| 3,874,478 | 4/1975 | Mantell, Jr. | 184/1.5 |
| 3,954,250 | 5/1976 | Grace | 251/144 |
| 4,025,048 | 5/1977 | Tibbitts | 251/144 |
| 4,086,981 | 5/1978 | Mitsui | 184/1.5 |
| 4,231,544 | 11/1980 | Balch | 251/301 X |
| 4,298,182 | 11/1981 | Balch . | |

FOREIGN PATENT DOCUMENTS

| | | | |
|---|---|---|---|
| 750263 | 3/1965 | Canada | 251/301 |
| 27890 | 6/1921 | Denmark | 251/115 |
| 17246 | of 1894 | United Kingdom . | |

*Primary Examiner*—Samuel Scott
*Assistant Examiner*—Carl D. Price
*Attorney, Agent, or Firm*—James R. Cypher

[57] ABSTRACT

A finger operated drain valve for crankcases, radiators and bilge drains having a slide gate held in the closed position by a locking spring.

3 Claims, 27 Drawing Figures

LOCKING DRAIN VALVE

BACKGROUND OF THE INVENTION

The drain plug for crankcases of most internal combustion engines used today is essentially the same as the drain plugs used in the first internal combustion engines as documented in my U.S. Pat. Nos. 4,231,544, Nov. 4, 1980; and 4,298,182, Nov. 3, 1981.

It has been estimated that 60% of the motoring public or 85 million American motorists in 1980 changed their own oil and it is believed that this estimate has risen in the last two years. Even though the price of gasoline has decreased recently, the price of motor oil has not and motorists continue to seek ways to reduce the high cost of driving. Changing the oil in an automobile remains a dirty job, the plug can be mislaid, and if not properly threaded back into the crankcase opening, the threads can become stripped and an oversize plug required.

Inventors in this field have been active, but as yet, the standard plug is used on all new production cars sold in the United States and the use of after market drain plug alternatives remains miniscule.

The first efforts to replace the standard drain plug took the form of mechanisms to enable the oil to be drained by simply operating a remote mechanism on the dash board. Such devices may be seen in such U.S. patents as U.S. Pat. No. 2,095,696, Oct. 12, 1937; No. 2,657,705, Nov. 3, 1953; No. 3,049,334, Aug. 14, 1962; No. 3,677,369, July 18, 1972; No. 3,954,250 May 4, 1976; and No. 4,086,981, May 2, 1978. In addition to the extra cost of these mechanisms, it is still necessary to get under the car to catch the used oil so little is gained by the expenditure. More importantly, however, it is essential that the mechanism be fail-safe since loss of engine oil can result in severe damage to the engine. The use of a complicated mechanism only increases the possibility of failure of the mechanism and loss of engine oil.

Since the collection and disposal of used oil is a problem to the weekend mechanic U.S. Pat. No. 3,874,478, Mar. 20, 1974, provides a valve and collection bag.

The valve member and spring retainer, however, must be detached from the mechanism and both may be mislaid.

Another valve and used oil collection device is taught in U.S. Pat. No. 4,025,048. This device has no positive means for locking the device in the closed position and could inadvertently become unscrewed and leak.

My own U.S. Pat. Nos. 4,231,544 and 4,298,182 supra solved the locking problem but market acceptance has been slow due to the preference for metal crankcase drain valves instead of the use of plastic taught in my patents. Further, the proliferation of foreign and U.S. small four (4) cylinder cars has resulted in the use of many different crankcase hole sizes and different threads so that the necessity of providing many different sizes is not cost effective for plastics.

This application discloses a crankcase drain valve which uses a slide gate with a positive locking spring.

Examples of slide valves without locking springs are taught in U.S. Pat. No. 303,656, Aug. 19, 1884; U.S. Pat. No. 450,588, Apr. 14, 1891 and United Kingdom Pat. No. 17,246, 1894. The United Kingdom patent discloses a rubber band closure device which is not considered to be a locking spring.

SUMMARY OF THE INVENTION

The crankcase drain valve of the present invention permanently replaces the standard drain plug and thus never needs to be unthreaded from the crankcase thereby eliminating the problem of stripped threads or rounding off the head through the use of wrong size wrenches.

The present drain valve has no removeable parts so that there is no way to misplace or lose one of the parts while changing the oil.

The handle of the slide gate is to the side of the valve body so that used hot oil can be emptied directly into a container without soiling the hands of the person draining the oil.

The slide gate is locked in the closed position by a spring which insures that the slide gate will remain in the closed position.

The drain valve of the present invention is constructed from metal insuring its durability and it may be made on standard machines so that many different sizes can be easily and inexpensively provided.

The unique design of a modified form of the present valve permits it to be installed by an allen wrench for motorcycle crankcases where vibration is excessive and in automobile radiators.

The valve of the present invention may be constructed from stainless steel and used as a bilge valve in small boats.

DESCRIPTION OF THE PREFERRED EMBODIMENTS

Figure 1:
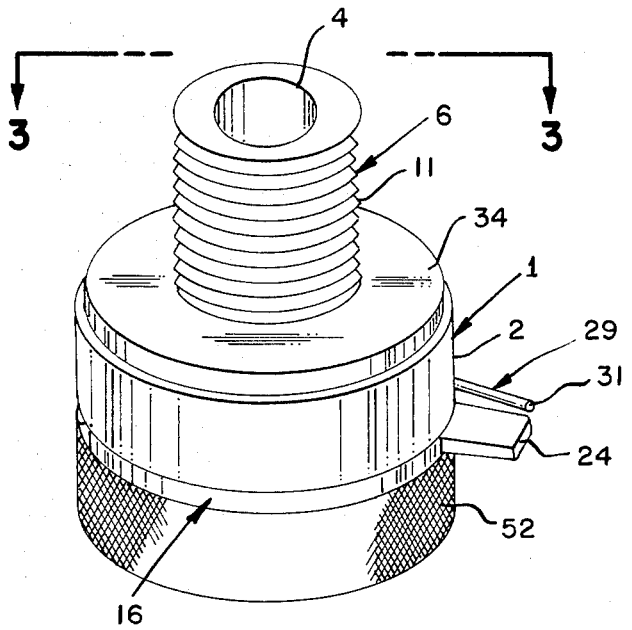
FIG. 1 is a perspective view of the finger tip operated drain valve of the present invention. The valve is in the closed position.
Figure 3:
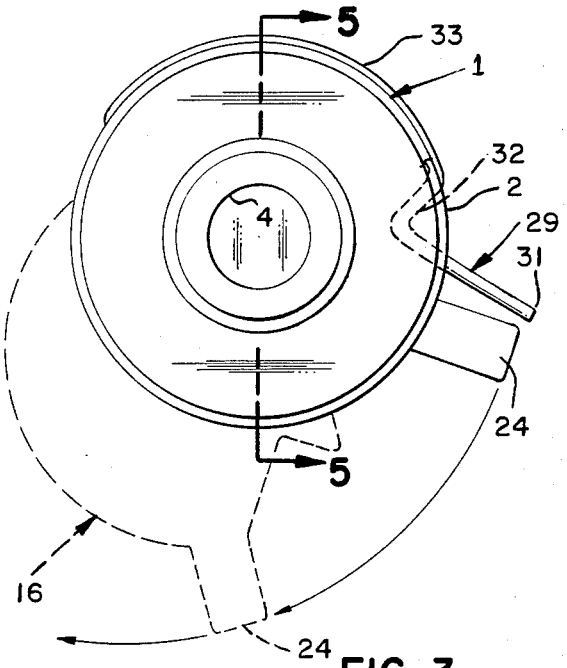
FIG. 3 is a top plan view taken along line 3—3 of FIG. 1. The solid lines show the slide valve in the closed position and the phantom lines show the slide valve in the open position.
Figure 2:
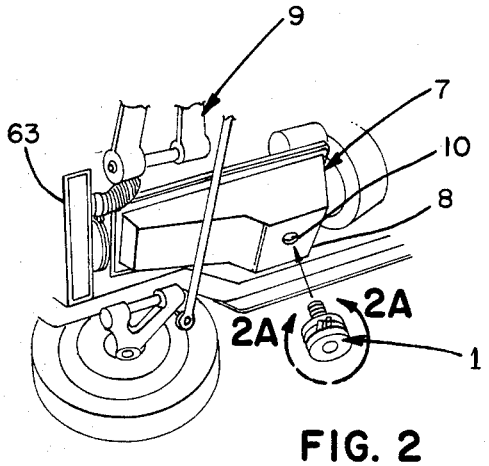
FIG. 2 is a perspective representation of a portion of an automobile and the crankcase drain opening with the valve removed.
Figure 2A:
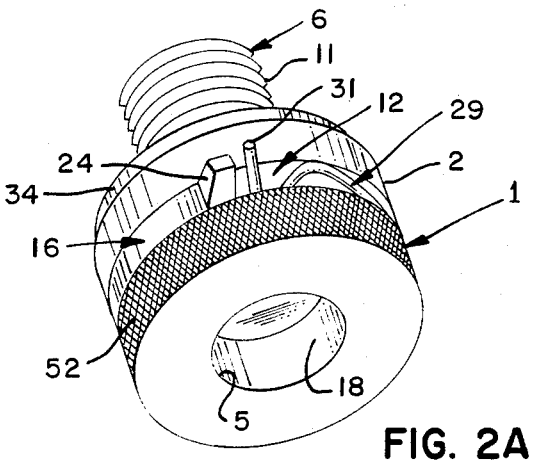
FIG. 2A is a perspective view of the valve of the present invention.
Figure 4:
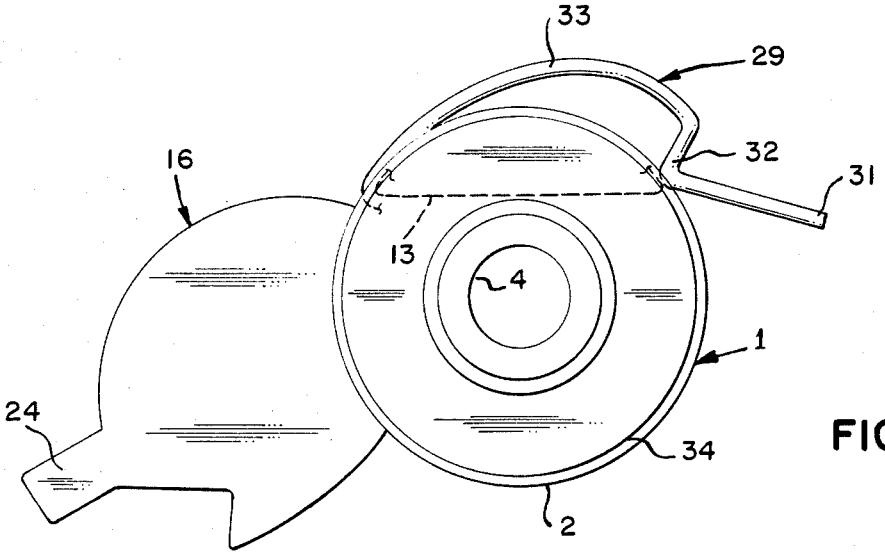
FIG. 4 is a top plan view of the valve shown in FIG. 1 taken in the direction of line 3—3 with the slide valve in the full open position and the spring held in the full release position. The dotted line indicates the inner edge of the body portion in the plane of the slide gate.
Figure 5:
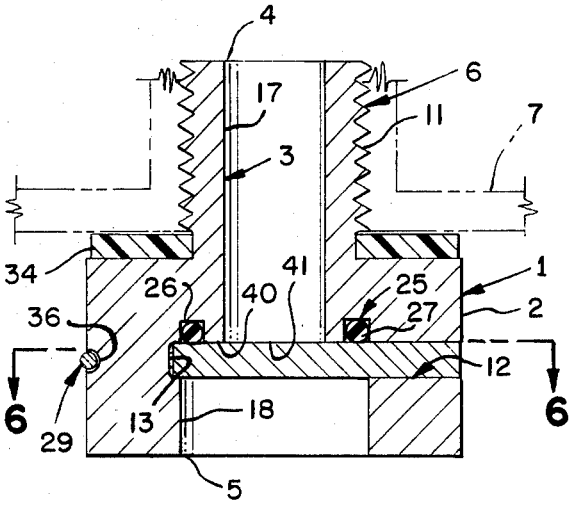
FIG. 5 is a cross section of the valve taken generally along line 5—5 of FIG. 3. The phantom line indicates a portion of the crankcase surrounding the crankcase opening.

The locking drain valve assembly of the present invention consists of a valve housing 1 formed with sidewalls 2 and a passage 3 therethrough including an inlet opening 4 and an outlet opening 5. The housing is formed with connection means 6 adapted for connection to a fluid source 7. As illustrated in FIG. 2 the fluid source may be a crankcase 8 of an automobile 9 formed with an internally threaded opening 10. Preferably the connection means 6 includes a threaded shank 11 which is simply rotatably inserted into threaded opening 10 of the crankcase in the standard manner. Once the shank is inserted in the crankcase opening, it is unnecessary to ever remove the valve from the crankcase.

The housing is formed with a transverse slot 12 which intersects the passage 3 and terminates at an inside slot wall 13. The walls 14 and 15 of the slot are parallel and smooth and extend across the valve housing so as to surround the passage 3. A slide gate 16 is dimensioned for sliding registration within the transverse slot. The portion 17 of the passage 3 upstream of slot 12 is dimensioned to provide the largest passage consistent with providing a strong structural shank 11. Preferably the portion 18 of passage 3 downstream of slot 12 is coaxial with portion 17 but has a greater diameter so that oil passing through the valve will be less likely to flow out the slot when the crankcase is being drained. The slide gate has a portion 39 dimensioned to cover the annular seat area 40 and the opening 41 in the upstream portion 17 of the passage.

A pin means 19 consisting of a pin 20 force fit into upper and lower pin openings 21 and 22 is inserted through opening 23 in the slide gate to provide for pivotal movement of the slide gate into and out of closure position with passage 3. The slide gate is formed with a finger engageable lever 24 which extends outwardly beyond the sidewall 2 of the housing. The length of the lever is dimensioned so that the lever extends beyond the sidewall for all pivotal positions of the slide gate from fully open to fully closed.

Figure 9:
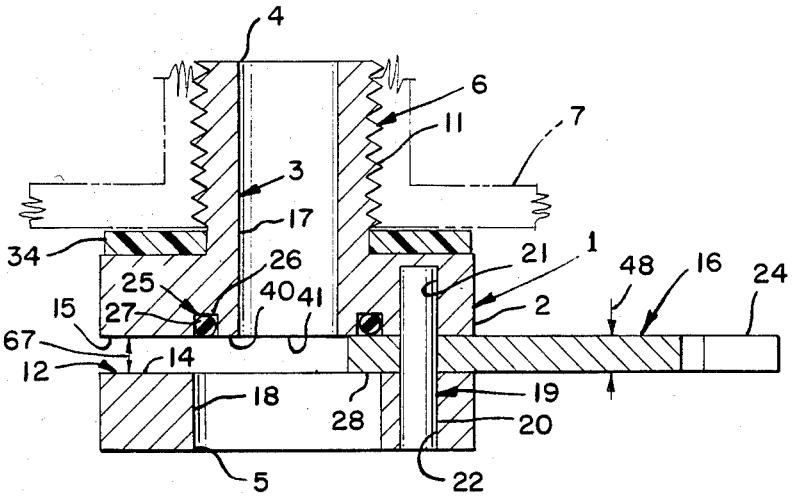
FIG. 9 is a cross section of the valve taken along line 9—9 of FIG. 8 showing the slide valve in the fully open position. The phantom lines show a portion of the crankcase in the vicinity of the opening.
Figure 10:
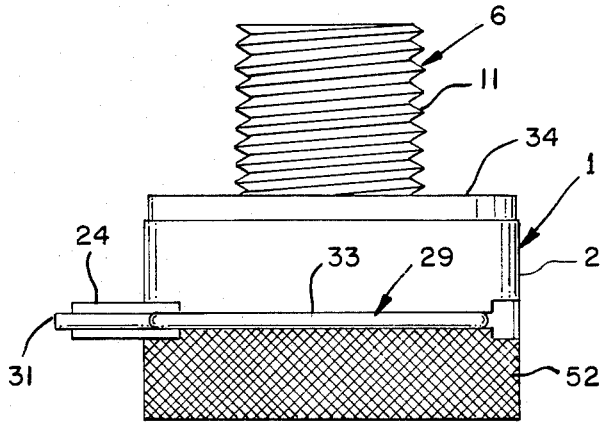
FIG. 10 is a side view of the valve taken along line 10—10 of FIG. 6.

Slide gate sealing means 25 is mounted in the housing surrounding the passage and sealably engages the slide gate member in the closed position for preventing flow of fluid through the passage. The sealing means may consist of an annular groove 26 formed in slot wall 15 surrounding upstream passage 17 and an O-ring 27 dimensioned for force fit therein. As shown in FIG. 9, the O-ring protrudes beyond the groove 26 and slot wall 15 so that slide gate 16 compresses the O-ring in the closed position. Preferably, the slide gate is dimensioned so that a nose portion 28 is always in engagement with a portion of the O-ring from the fully open to the fully closed position of the slide gate to assist in the prevention of the O-ring from separating from its annular groove 26.

The slide gate is locked in a closed position by a spring means 29 which includes a proximal end 30 connected to the housing and a distal end 31 projecting beyond the body sidewall adapted for finger engagement release, a V-shaped portion 32 formed adjacent the distal end for releasable engagement with the spring engageable portion 42 in the slide gate in the closed position of the slide gate, a mid-portion 33 formed between the V-shaped portion and the proximal end portion and extending from the side of the valve body in the unlatched position and moveable to a latched position by finger compression.

The housing and the crankcase are sealed by a housing sealing means 34 which may simply consist of an elastic washer 34.

The housing may be formed with a spring holding means formed in the housing for releasably engaging the V-shaped portion of the spring when the spring is moved to the unlatched position permitting easy unbiased movement of the slide gate to the closed position. The spring holding means may be accomplished by merely forming an edge 35 at the intersection of the inside slot wall 13 and a spring retaining groove 36 formed in the sidewall 2 of the housing. The purpose of the spring holding means is best understood from a description of the inter-relation of the slide gate and the spring during opening and closing of the slide gate.

Figure 6:
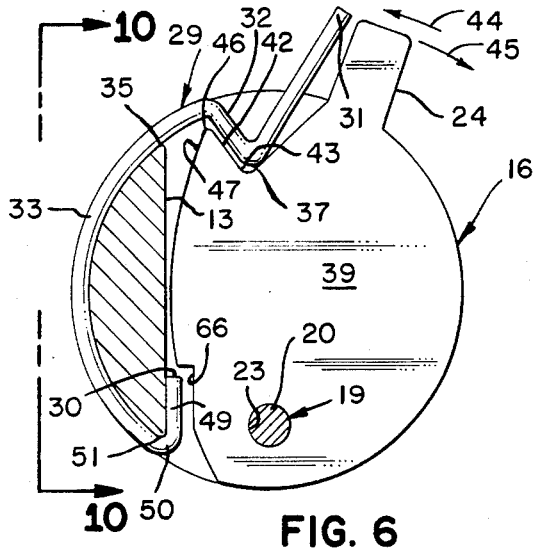
FIG. 6 is a cross section of the valve taken along line 6—6 of FIG. 5. The valve is shown in the closed position.
Figure 7:
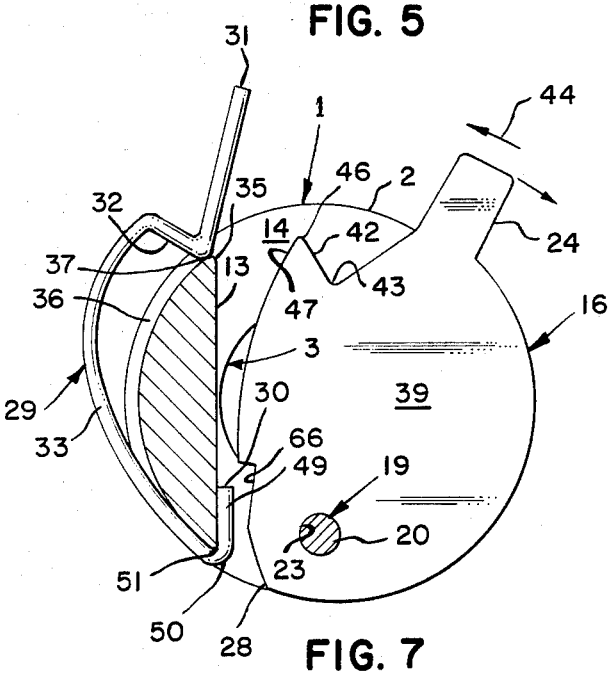
FIG. 7 is a cross section of the valve taken along line 6—6 of FIG. 5 with the slide valve in the partially open position and the spring in the fully open position. The spring 15 held in the fully open position by the body portion in the plane of the slide gate.

As illustrated in FIG. 6, showing the gate in the closed position, the tip 37 of the V-shaped portion of the spring means 29 rests in the apex 43 of the spring engageable portion 42 of the slide gate 16. The spring is dimensioned and configured so that the tip 37 of the spring 29 constantly biases portion 42 and urges the slide gate in a counter clockwise direction as indicated by arrow 44 in FIG. 6. This holds and locks the slide gate in the closed position. To open the valve, it is merely necessary to press ones finger or finger nail against distal end 31 of spring 29 in a counter clockwise direction as shown by arrow 44 in FIG. 6 until the top 37 of spring 29 clears edge 46 of the spring engageable portion 42 of the slide gate. This movement causes midportion 33 of spring 29 to move outwardly from the wall of the valve housing and out of portions of the spring retaining groove 36. The slide gate is now in the unlatched mode and may be rotated clockwise by placing the finger tip against finger engageable lever 24 and moving the slide gate in the direction of arrow 45 in FIG. 6. The position of housing edge 35 may be placed in close proximity to the position of edge 46 when the side gate is in the closed position so that when the distal end 31 of the spring is moved in a counter clockwise direction, the tip 37 of the V-shaped portion of the spring will move past the edge 35 on the housing and remain in frictional engagement with the spring retaining groove 36 as shown in FIG. 7. The slide gate 16 may now be pivoted in a clockwise movement about pin 20. Oil or other fluid may now pass freely through portion 17 of passage 3, through opening 41 and though passage 18 and out outlet opening 5.

Figure 8:
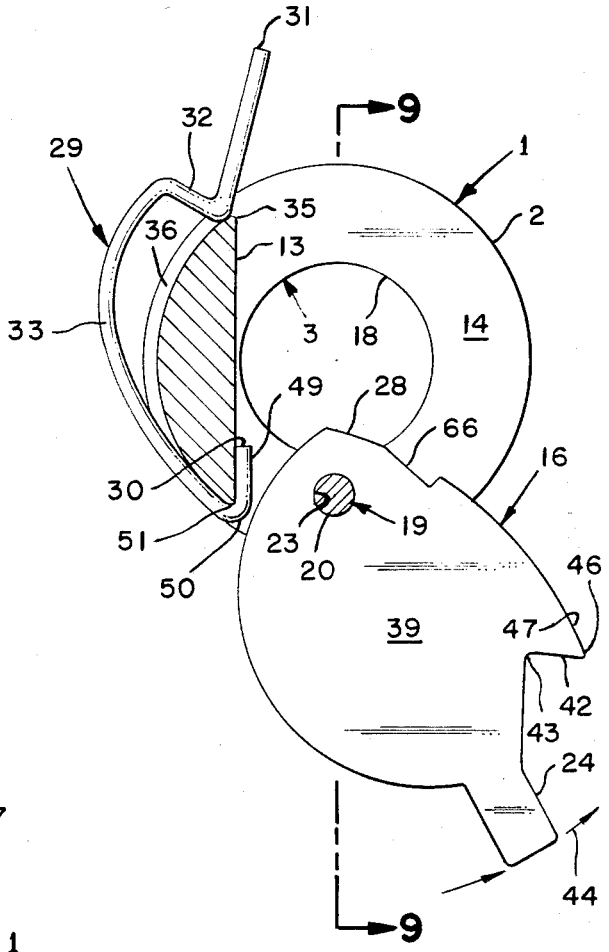
FIG. 8 is a cross section of the valve taken along line 6—6 of FIG. 5 with the slide valve in the fully open position. The spring is in the fully open position.

In some valves, it may be desirable to leave sufficient space between edges 35 and 46 so that after tip 37 of the spring clears edge 46 of the sliding gate, the spring may be released and tip 37 of the spring will engage portion 47 of the edge of the slide gate and immediately urge the slide gate in a clockwise direction as shown by arrow 45 in FIG. 6 thereby biasing the slide gate to the open position. Since the spring will not completely open the slide gate, a finger must be placed against lever 24 to move the gate clockwise as shown by arrow 45 to a completely open position as illustrated by FIG. 8.

Closing the slide gate is a simple one-handed operation. The initial location of the spring is immaterial. The tip 37 of the V-shaped portion of the spring may be resting on the edge 35 of the housing or on some part of the spring retaining groove 36 or the spring may be untensioned with the mid-portion 33 resting in groove 36 and the tip 37 located within the transverse slot 12. The first step is to move the slide gate to the closed position by pushing on lever 24 with the finger tip. As illustrated in FIGS. 6, 7 and 8, the lever should be rotated counter clockwise in the direction of arrow 44. When the slide gate is in the closed position either the thumb or index finger should be placed on lever 24 and pressed to the close position while either the thumb or index finger of the same hand is pressed against the mid-portion 33 of the spring. This will cause the tip 37 of the spring to move over edge 46 of the slide gate and snap into the spring engageable portion 42 and come to rest in the apex 43 of portion 42 of the slide gate. The slide gate is now locked in the closed position and the fluid source, such as an automobile crankcase may be refilled with oil. As shown in FIG. 6, the finger engageable lever of the slide gate and the distal end of the spring are positioned in close proximity when the slide gate is in the closed position and the spring is near its latched position for partial protection of the distal end of the spring and for one-hand finger-latching of the spring.

Figure 11:
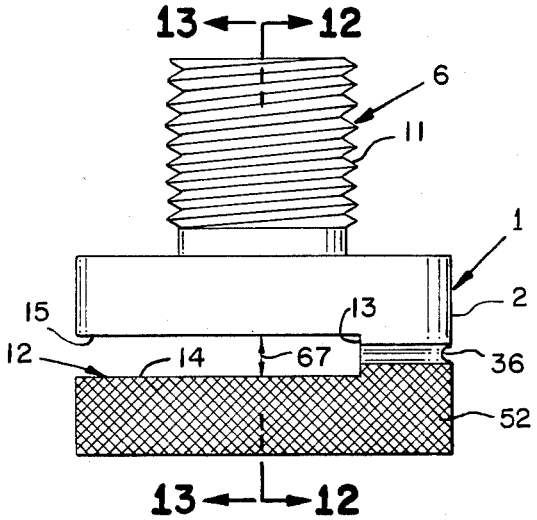
FIG. 11 is a side view of the valve with all elements removed from the valve body.
Figure 12:
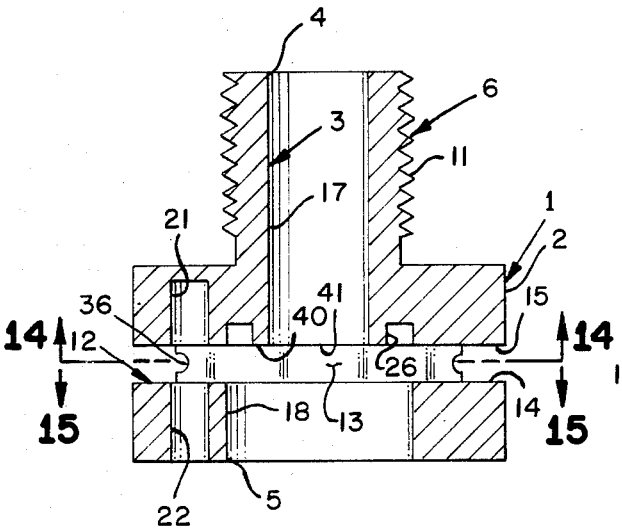
FIG. 12 is a cross section of the valve body taken along line 12—12 of FIG. 11.
Figure 13:
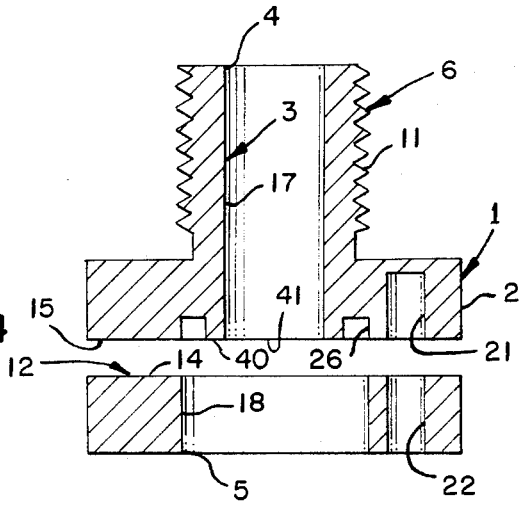
FIG. 13 is a cross section of the valve body taken along line 13—13 of FIG. 11.
Figure 14:
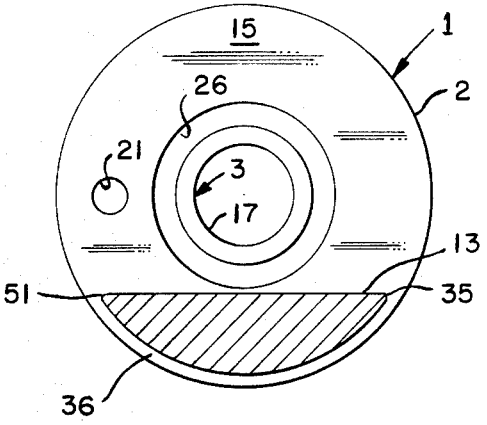
FIG. 14 is a cross section of the valve body taken along line 14—14 of FIG. 12.
Figure 15:
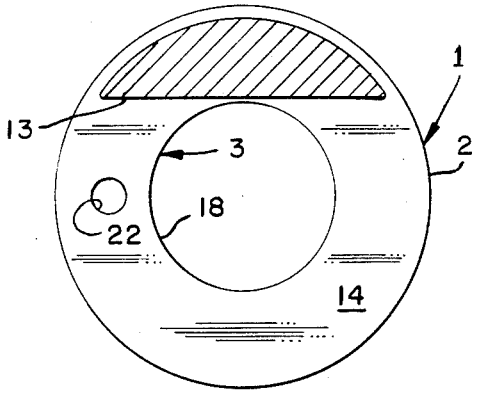
FIG. 15 is a cross section of the valve body taken along line 15—15 of FIG. 12.
Figure 16:
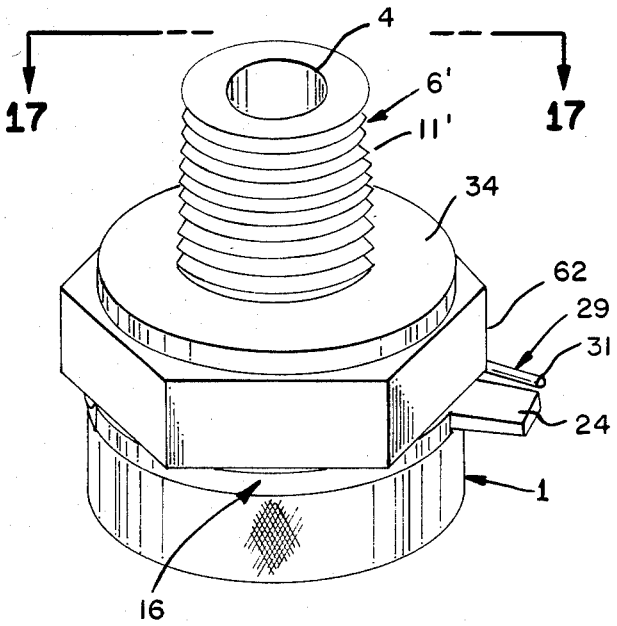
FIG. 16 is a perspective view of a modified form of the invention adapted for use as a bilge valve attached to the transom of a boat.
Figure 17:
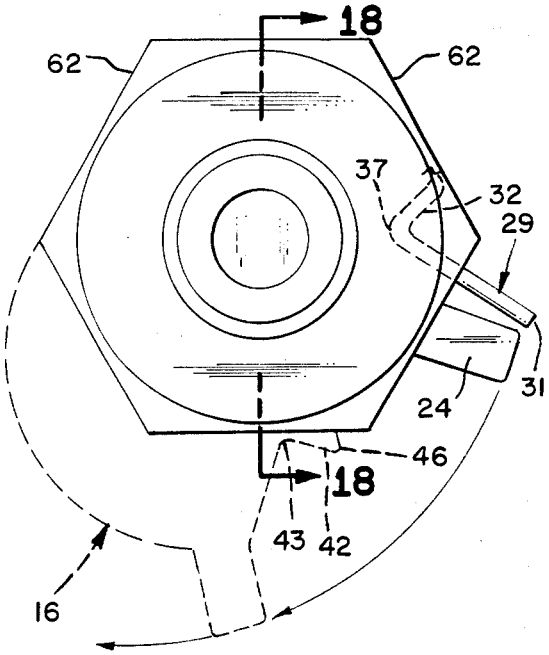
FIG. 17 is a top plan view of the valve shown in FIG. 16 taken along line 17—17.
Figure 18:
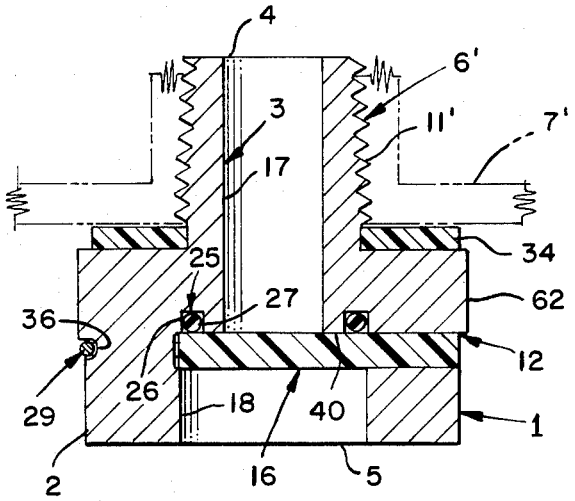
FIG. 18 is a cross section of the valve shown in FIG. 17 taken along line 18—18.
Figure 19:
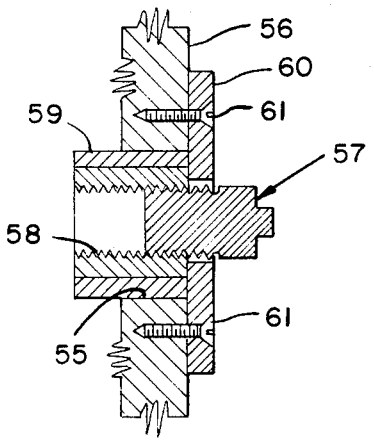
FIG. 19 (PRIOR ART)
FIG. 19 is a cross section of the transom of a boat showing a prior art drain plug.

The operation of the valve of the present invention requires that the portion 39 of the slide gate be maintained in close fitting contact with the O-ring 27. This requires that the portion 39 be biased against the O-ring 27. This biasing force is accomplished by carefully holding the tolerances on the valve construction so that the thickness of the transverse slot 12 as represented by the double arrows 67 in FIG. 11 is greater than the thickness of the slide gate 16 as represented by the double arrows 48 in FIG. 9 but small enough to always cause the O-ring 27 to be in compression when the gate is closed. Since the transvere slot 12 leaves only a relatively small valve segment as represented by the cross hatched segment indicated in FIGS. 6, 7 and 8 and bounded by inside slot wall 13 and spring retaining groove 36, it is important, as an added safety feature, to dimension pin 20 and upper and lower pin openings 21 and 22 so that they are in a force fit and will add further structural rigidity to the valve housing and hold wall 14 of the slot in the same relative position with wall 15 of the slot.

The spring means 29 may be attached to the housing by various means. A simple, yet effective way is to form the proximal end 30 is with a hook shape so that a segment 49 of the spring protrudes into the transverse slot 12 and lies against inside slot wall 13. The spring is formed with a sharp bend 50 so that the bend occurs at the intersection 51 of inside slot wall 13 and spring retaining groove 36 as shown in FIGS. 6–8. The hook shape of the spring insures that the spring is non-removeable under all operative conditions and is in close fitting relation to the spring retaining groove at the proximal end. A cutout 66 is formed in slide gate 16 to register with spring segment 49.

For ease in installing the valve, a portion 52 of the outer sidewall of the housing is formed with knurled portions. Since no means is provided for installing the valve with a wrench, the knurled portion prevents slipping of the fingers on the valve.

Figure 20:
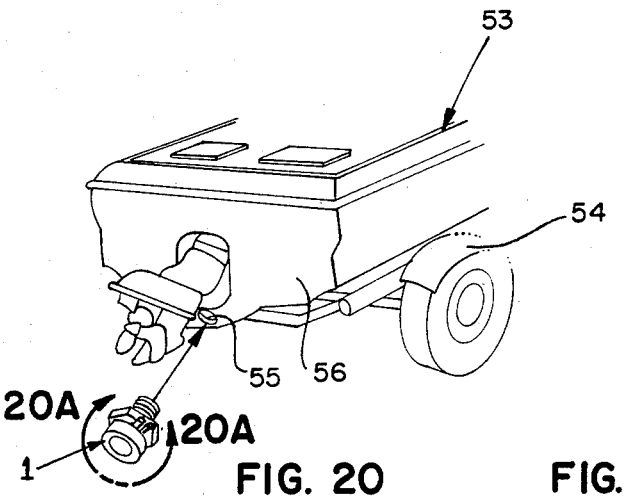
FIG. 20 is a perspective of a portion of a boat and trailer showing the opening into which the drain plug of FIG. 16 is fitted. The drain plug is shown in enlarged scale.
Figure 20A:
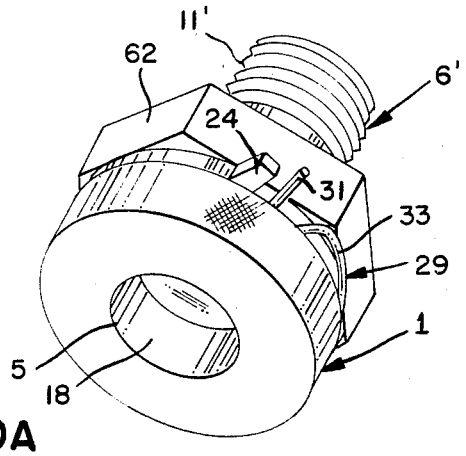
FIG. 20A is an enlargement of the valve shown in FIG. 20.
Figure 21:
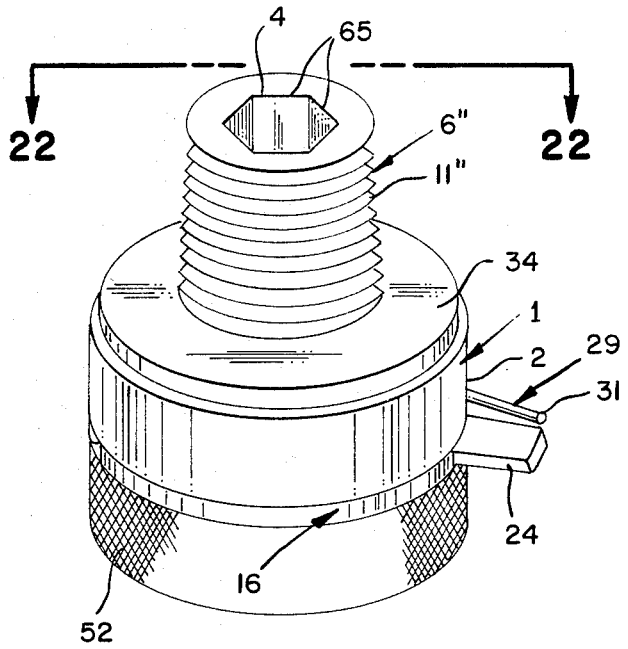
FIG. 21 is a perspective view of still another form of the invention adapted for use as a radiator drain valve.
Figure 22:
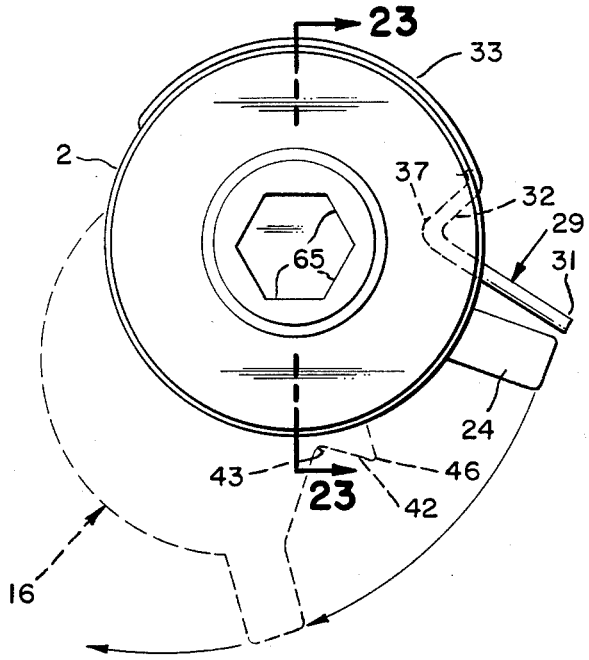
FIG. 22 is a top plan view of the valve shown in FIG. 21 taken along line 22—22.
Figure 23:
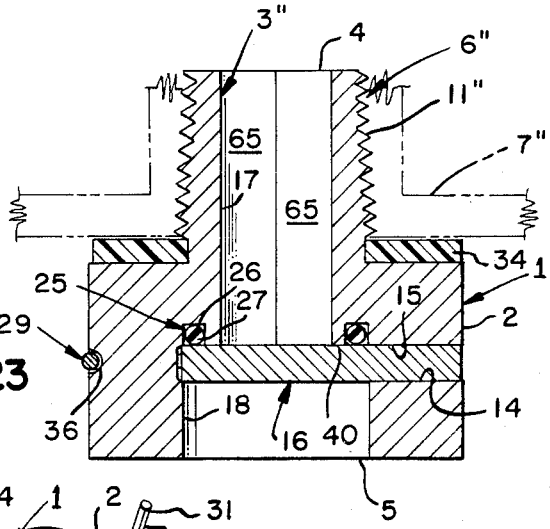
FIG. 23 is a cross sectional view of the valve shown in FIG. 22 taken along line 23—23.

FIGS. 16–20A illustrate another form of the valve which is modified to replace the drain plug on small boats. FIG. 20 shows a partial view of a small boat 53 on a trailer 54. Such boats have an opening 55 in the transom 56 for receipt of a drain plug 57 as shown in the prior art FIG. 19. The prior art teaches an assembly consisting of an internally threaded sleeve 58 surrounded by a sealing sleeve 59 placed in opening 55. A protector plate 60 is attached to the transom 56 by screws 61 and the threaded plug 57 is threaded into sleeve 58. The problem with such plugs is that in order to drain the bilge water from a boat, the plug must be completely removed. The plug can be mis-laid while the water drains. It can be an irksome task to buy a new plug to replace a lost plug; it can also be a catastrophe if the boat leaves the dock with the plug left on the dock. More than one boat has sunk for lack of a bilge plug.

Very little modification of the valve of the present invention is required to provide a marine valve to replace a bilge plug. The valve should be constructed of stainless steel or other non-corroding metal and a portion of the outer sidewall of the housing should be formed with faceted faces 62 so that the valve may be installed with a wrench. Since most internally threaded sleeves are formed for receipt of pipe threaded plugs, the connection means 6' should be a tapered shank 11' and formed with pipe threads. The slide gate may be formed from plastic such as polyetheylene. Except for the differences set forth above, the valve is identical to the valve described above and illustrated in FIGS. 1–15. Like parts have been given identical numbers and the description and operation is not repeated for purposes of brevity.

Figure 24:
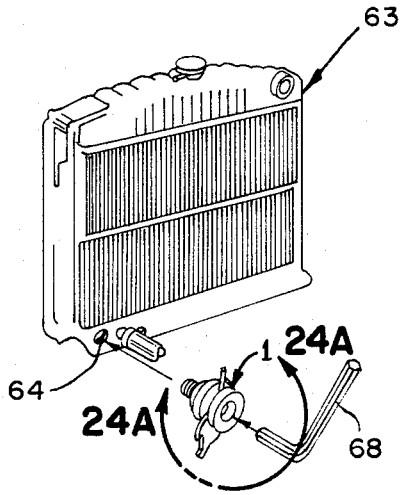
FIG. 24 is a perspective view of a radiator for an internal combustion engine showing the drain opening. The drain valve is shown in enlarged scale.
Figure 24A:
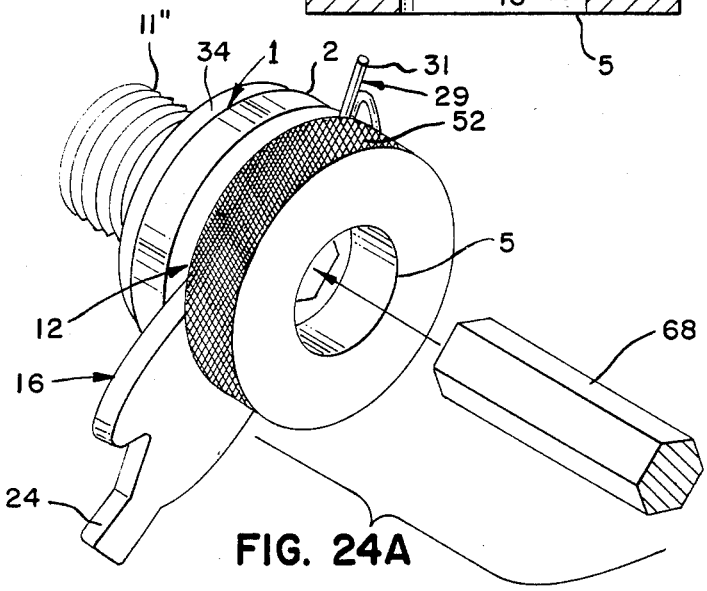
FIG. 24A is a perspective of the drain valve shown in FIG. 24 on a greatly enlarged scale. A portion of an allen wrench for installing the valve is illustrated.

Still another form of the invention is illustrated in FIGS. 21–24A. This form of the invention is used to replace automobile and truck radiator drain valves which are often difficult to open and close for seasonal coolant changes. FIG. 24 illustrates a typical radiator 63 with its internally threaded opening 64. For installation purposes, the inner passage 3'' is formed with facets 65 so that an allen wrench 68 may be inserted into passage 3'', and engage facets 65 for rotation of the valve housing. The connection means 6'' should be formed with a tapered shank 11'' pipe threads for insertion into opening 64 in the radiator. All parts of the valve which are identical to the valve previously described and illustrated in FIGS. 1–15 have been given identical numbers. The description of the parts and operation is identical to the valve previously described and is not repeated for purpose of brevity.

The drain valve of the present invention may also be formed with connections means 6 dimensioned to fit the crankcases of motorcycles. Because of the extreme vibration present in motorcycles, the drain valve preferably should be constructed as illustrated in FIGS. 21–24A so that it can be installed with an allen wrench. Because the construction is identical to the valve described for installation in radiators, the valve is not illustrated or described. The claims, however, are believed to cover the type of drain valve in this type of installation.

To permit the slide gate to operate reliably and without forcing the O-ring out of its groove 26, it was found that the inside wall of groove 26 should have the same inside diameter as the O-ring and the diameter of the outside wall of the groove should be slightly larger than the outside diameter of the O-ring.

A very important feature of the operation of all forms of the invention is the fact that it is very difficult to accidentally open the valve during operation of any vehicle equipped with the valve of the present invention. For example, if a small stone or other obstruction should be thrown against the spring end 31 or slide gate lever 24, it should be noted that to open the gate, the spring end and gate lever must be moved in opposite directions. Since the spring end and gate lever 24 are placed close together as shown in FIG. 6, the probability of a stone wedging between these two parts and opening the gate is very remote.

I claim:

1. A locking drain valve assembly comprising:

a. a valve housing (1) formed with sidewalls (2) and a passage (3) therethrough including an inlet opening (4), an upstream portion (17), an opening in said upstream portion, an outlet opening (5), an annular seat area (40) surrounding said passage;

b. said housing being formed with connection means (6) adapted for connection to a fluid source (7);

c. said housing being formed with a transverse slot (12) intersecting said passage creating an opening (41) in said passage and terminating at an inside slot wall (13) within said housing;

d. a slide gate member (16) dimensioned for registration within said transverse slot and having a portion (39) dimensioned for covering said annular seat area (40) and said opening (41) in said upstream portion (17) of said passage;

e. pin means (19) connected to said housing and said slide gate for pivotal movement of said slide gate into and out of closure position with said opening (41) in said upstream portion (17) of said passage (3);

f. said slide gate being formed with a finger engageable lever (24) extending beyond said side of said housing;

g. slide gate sealing means (25) mounted in said housing surrounding said passage and sealably engaging said slide gate member in said closed position for preventing flow of fluid through said passage;

h. said slide gate being formed with a spring latch engageable portion (42);

i. spring latch means (29) having a curvilinear cross section moveable between a latched and an unlatched position, including a proximal end (30) connected to said housing and a distal end (31) projecting beyond said side wall (2) adapted for finger engageable release, a V-shaped portion (32) formed adjacent said distal end for releasable engagement with said spring engageable portion in said slide gate in said closed position of said slide gate, a mid-portion (33) arcuately formed between said V-shaped portion and said proximal portion extending from said side of said valve body in said unlatched position and moveable to a latched position by finger compression;

j. housing sealing means (34) adapted for sealing said valve housing to said fluid source;

k. a portion of said side of said housing is formed with an annular groove (36) dimensioned for receiving a portion of said spring latch means;

l. the proximal end (30) of said spring latch means is formed with a hook shape for operative non-removeable engagement of an end of said annular groove and said inside slot wall permitting spring deforming rotational movement of said distal end of said spring latch means relative to said proximal end;

m. spring latch holding means (35) formed in said housing for releasably engaging said "V38 shaped portion of said spring latch means when said spring latch means is moved to said unlatched position permitting easy unbiased movement of said slide gate between said open and closed positions;

n. said spring latch means is positioned with respect to said slide gate so that it must be moved counter to said slide gate to effect unlatching; and p1 o. said sealing means (25) includes an annular groove (26) formed in said housing surrounding said passage in an upstream side of said slot; and p. an "o" ring (27) dimensioned for receipt within said annular groove and dimensioned for sealing receipt with said slide gate in said closed position.

2. A valve as described in claim 1 wherein:

a. said pin means includes a pin (20) and two in line openings (21, 22) formed in said housing on either side of said slot dimensioned to frictionally receive said pin in tight fitting relation; and b. said pin is dimensioned to provide structural rigidity to said housing adjacent said slot.

3. A valve as described in claim 2 wherein:

a. said finger engageable lever of said slide gate and said distal end of said spring latch means are positioned in close proximity when said slide gate is in said closed position and said spring is near said latched position for partial protection of said distal end of said spring against accidental unlatching of said spring and for one hand finger latching of said spring.

* * * * *